US006168532B1

(12) United States Patent
McCaffrey

(10) Patent No.: US 6,168,532 B1
(45) Date of Patent: Jan. 2, 2001

(54) MULTI-CONFIGURATION SPORTS/ RECREATION FACILITY

(75) Inventor: Felim P. McCaffrey, Toronto (CA)

(73) Assignee: Hatch Associates LTD, Mississauga (CA)

( * ) Notice: Under 35 U.S.C. 154(b), the term of this patent shall be extended for 0 days.

(21) Appl. No.: 09/125,606

(22) PCT Filed: Feb. 21, 1997

(86) PCT No.: PCT/CA97/00121

§ 371 Date: Aug. 21, 1998

§ 102(e) Date: Aug. 21, 1998

(87) PCT Pub. No.: WO97/31156

PCT Pub. Date: Aug. 28, 1997

(30) Foreign Application Priority Data

Feb. 21, 1996 (CA) ..... 2170000

(51) Int. Cl.[7] ..... E04H 3/10
(52) U.S. Cl. ..... 472/92; 52/6
(58) Field of Search ..... 472/92, 88, 90, 472/91, 136; 52/6, 7, 8, 9, 10, 64

(56) References Cited

U.S. PATENT DOCUMENTS 4,038,834 * 8/1977 Roberts ..... 472/92 X

FOREIGN PATENT DOCUMENTS 2138690 10/1984 (GB) .
2263644 8/1993 (GB) .
2290239 12/1995 (GB) .
9100495 10/1992 (NL) .

* cited by examiner

*Primary Examiner*—Kien T. Nguyen
(74) *Attorney, Agent, or Firm*—Ridout & Maybee

(57) ABSTRACT

A sports/recreation facility is provided with seating bank around a playing area (2), and a grass playing surface (12) which is withdrawable from the playing area. The playing area is defined within one end of a shallow dock (16), the dock extending over the playing area and also extending sufficiently outside the playing area in one direction to define an area outside the playing area and seating banks having dimensions at least equal to the playing area. A shallow barge (14) is floatable within the dock and supports the playing surface for movement within the dock between the playing area and the outside area. The water (18) for introduction into the dock is stored within the barge. The dock extends beneath a bank of seating (8) at one side of the playing area, which bank may be formed as a movable unit with the barge providing storage for an additional body of water beyond that needed to float the barge in the dock, which water may be expelled from the barge into the dock so as to elevate the tank beneath the movable bank of seating, thus lifting the seating bank on the barge for movement with the barge between at least two alternatives locations relative to the remaining banks of seating and the playing area.

7 Claims, 9 Drawing Sheets

MULTI-CONFIGURATION SPORTS/ RECREATION FACILITY

This invention relates to a multiple configuration sports/recreation facility, and more particularly, although not exclusively, to such a facility providing a grass playing surface which is removable from a stadium area to a nearby location for maintenance and storage of the grass surface when not in use.

There has been a trend in recent years in sports and recreation facilities to provide at least spectators with an increasing degree of protection from the weather, resulting in turn in an increasing degree of enclosure of a central playing or performance area. This enclosure is inconsistent with the maintenance of grass playing surfaces such as are desirable or acquired for some sports, for example soccer. In general, it has not proved practicable to maintain over long periods a good quality grass playing surface within a stadium having a high degree of enclosure, and thus proposals have been made to provide such a playing surface in a form such that it may be removed from the playing area when not required, and stored in a suitable nearby facility where the grass can be properly maintained. Such an arrangement also has the advantage that, with the grass playing surface removed, the playing area is available for the staging of other types of events. The cost of erecting a modern stadium complex is such that very high utilization is a commercial necessity, which involves in turn the accommodation of many different types of events, for many of which the grass surface will not provide a suitable base. Arrangements providing removable grass surfaces are disclosed for example in WO 92/05690 (The Greenway Services, Inc.), GB 2138690A (Madden) and GB 2290239A (Luton Town Football and Athletic Company Limited). The latter two publications propose the use of air cushions for supporting portions of the playing surface for movement, but implementation of air cushion supports for large areas of playing surface which may present less than absolute rigidity are difficult to implement. On the other hand a rail based system for installing and removing the grass has the disadvantage that the rails must be covered before the playing area from which the grass has been removed can be used for any other purpose. Moreover, rails or other wheel based systems tend to impose concentrate loadings both on the base of the playing area and within the structures supporting the playing surface.

In order to provide maximum versatility in usage, it may also be desirable in a multi-purpose sports/recreation complex to provide for variation of the size of the stadium and/or the enclosed playing area. Thus some means is needed to reconfigure spectator seating areas relative to the playing area.

It is an object of the present invention to address the above problems.

According to the invention, a sports/recreation facility comprises a playing area; banks of seating disposed around that area; the playing area being defined within one end of a shallow dock, the dock extending over the playing area and also extending sufficiently outside the playing area in one direction to define an area outside of the playing area and seating banks having dimensions at least equal to the playing area; and a shallow barge floatable within the dock and supporting a playing surface for movement within the dock between said playing area and said outside area.

In a preferred arrangement, a body of water for introduction into the dock to float the barge is normally stored within the barge.

In a further preferred arrangement, the dock extends beneath a bank of seating at one side of the playing area, said bank of seating being formed as a movable unit, and the barge provides storage for an additional body of water beyond that needed to float the barge in the dock, which water may be expelled from the barge into the dock so as to elevate the tank when beneath said movable bank of seating, whereby to lift said seating bank for movement with said barge between at least two alternative locations relative to the remaining banks of seating and the playing area.

Further features of the invention will be apparent from description of a preferred embodiment thereof with reference to the accompanying diagrammatic drawings, in which:

FIGS. 1A to 7A are longitudinal sections through a facility in accordance with the invention, showing various phases of operation;

FIGS. 1B to 7B are corresponding plan views;

Figure 1A:
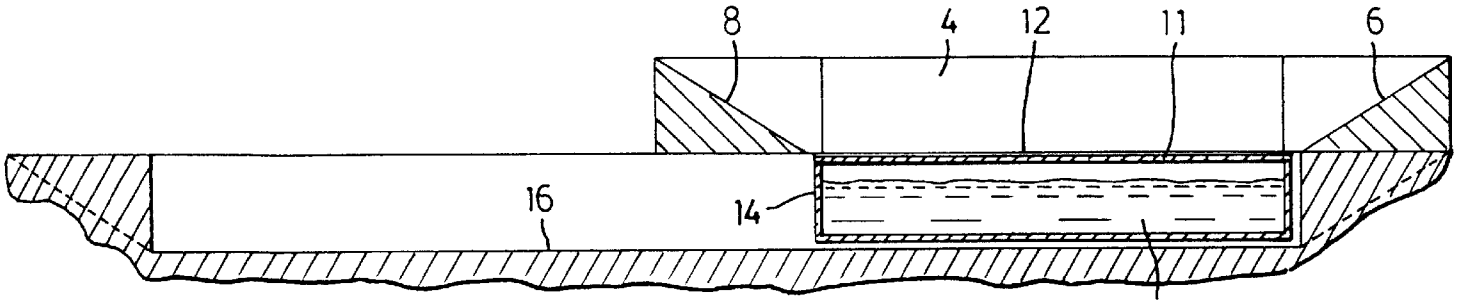
Figure 1B:
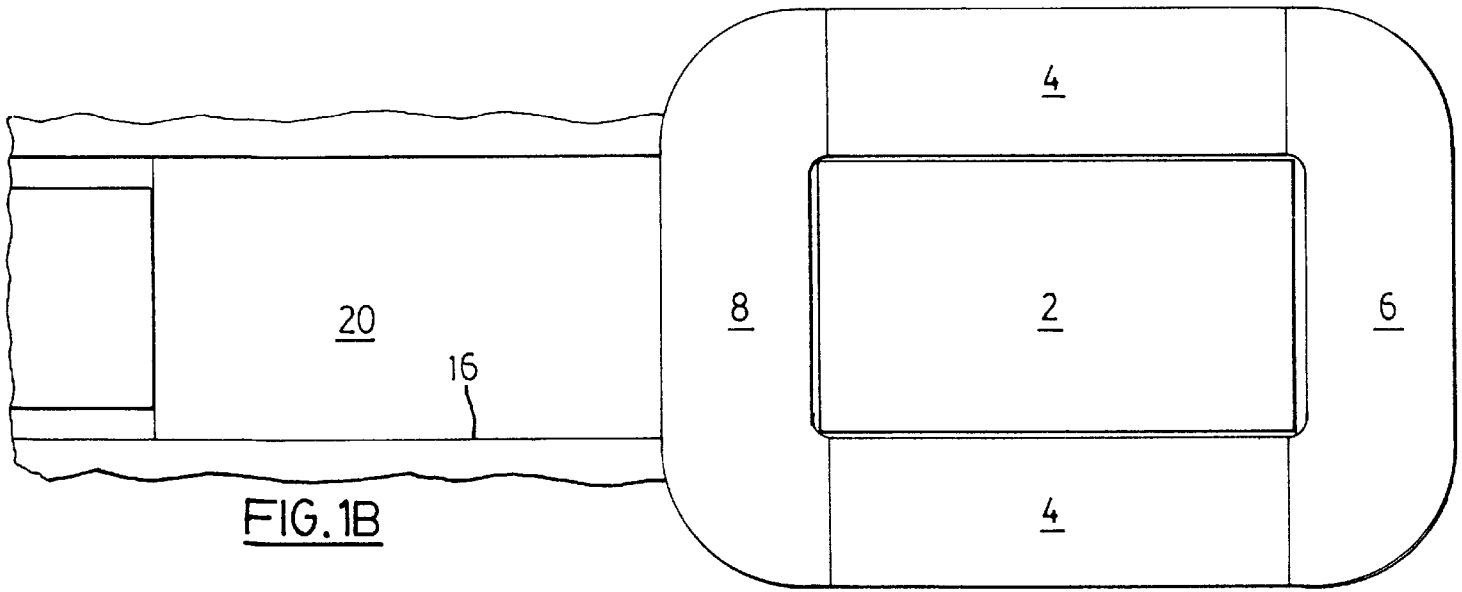

As seen in FIGS. 1A to 7A, the facility includes a playing area 2 surrounded by banks 4, 6 and 8 of seating. A playing surface 12, typically of grass, is located on an horizontal upper wall 11 of a shallow barge 14, seen located in FIGS. 1A, 1B and 2A, 2B within the playing area. The barge is located in a shallow dock 16, which extends over the playing area 2, and beneath the seating bank A into an area 20 equal to the playing area and exterior to the stadium formed by the seating banks and playing area and of sufficient dimensions to accommodate the barge 14.

The barge is filled with at least sufficient water 18 such as, when transferred into the dock, can float the barge and the playing surface which it supports. Thus FIG. 1 shows the barge and playing surface located within the playing area, with the water 20 within the barge.

Figure 2A:
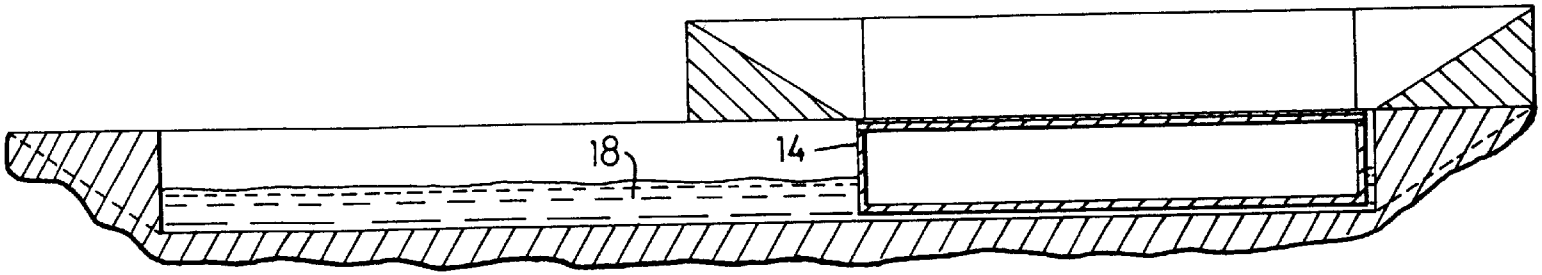
Figure 2B:
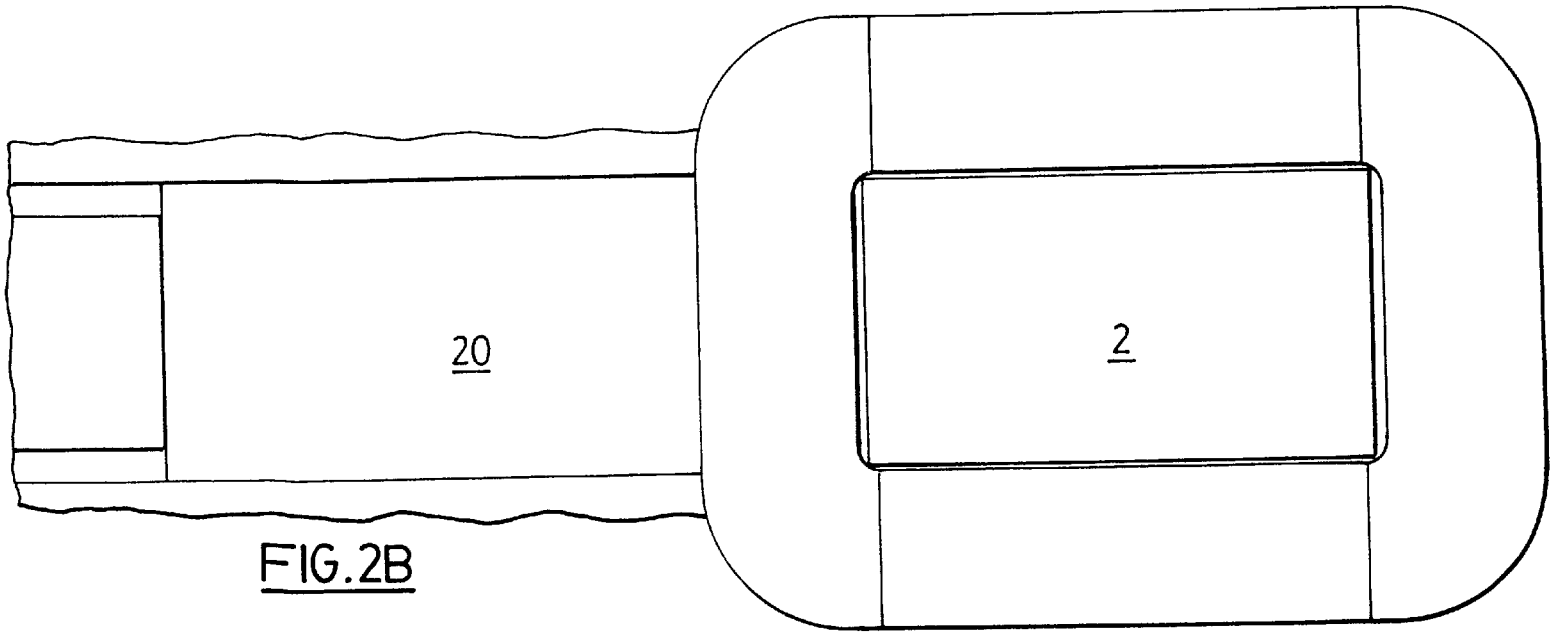

In FIGS. 2A and 2B, water has been displaced from the barge into the dock so as to float the barge in the playing area 2.

Figure 3A:
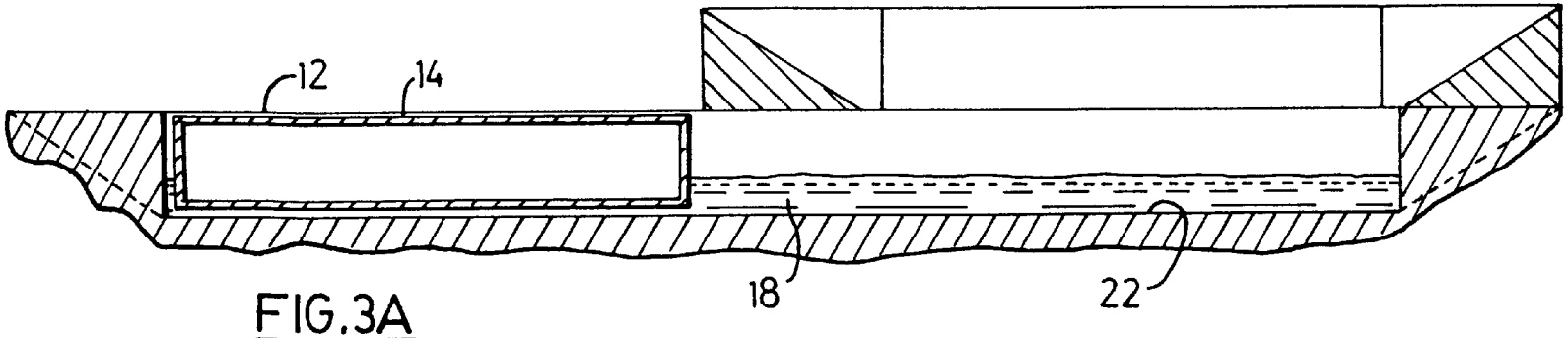
Figure 3B:
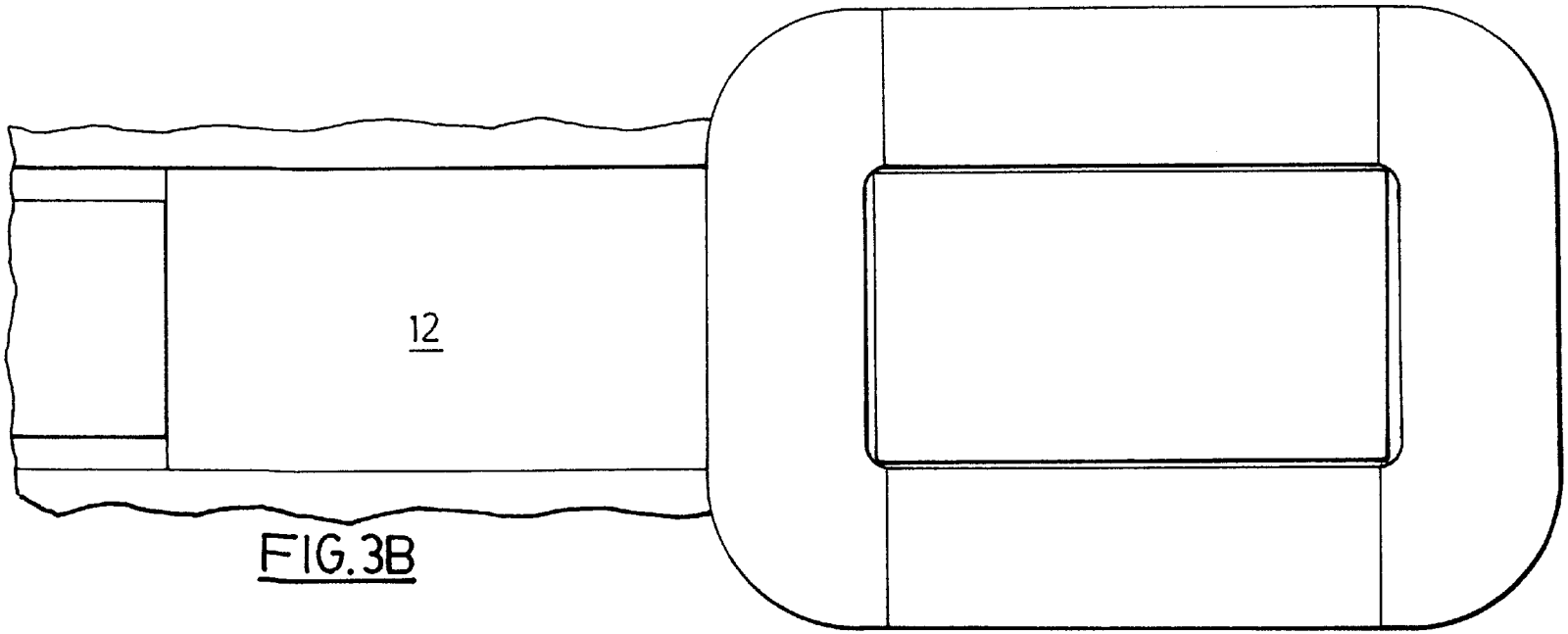
Figure 4A:
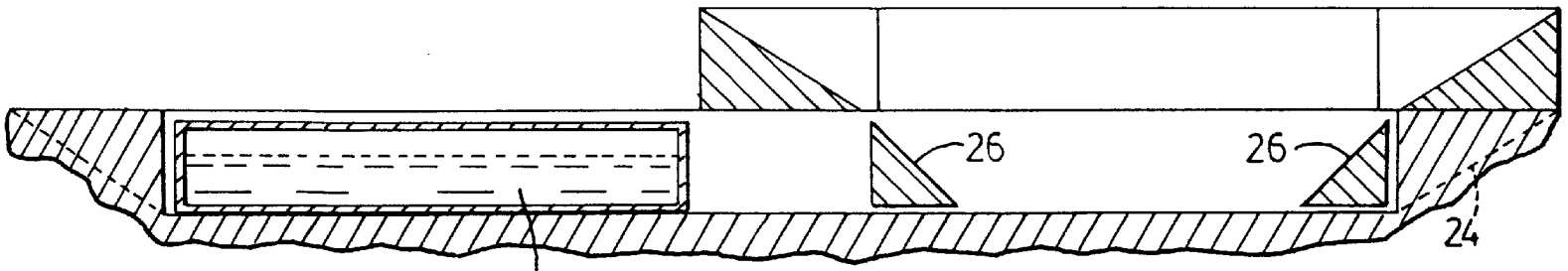
Figure 4B:
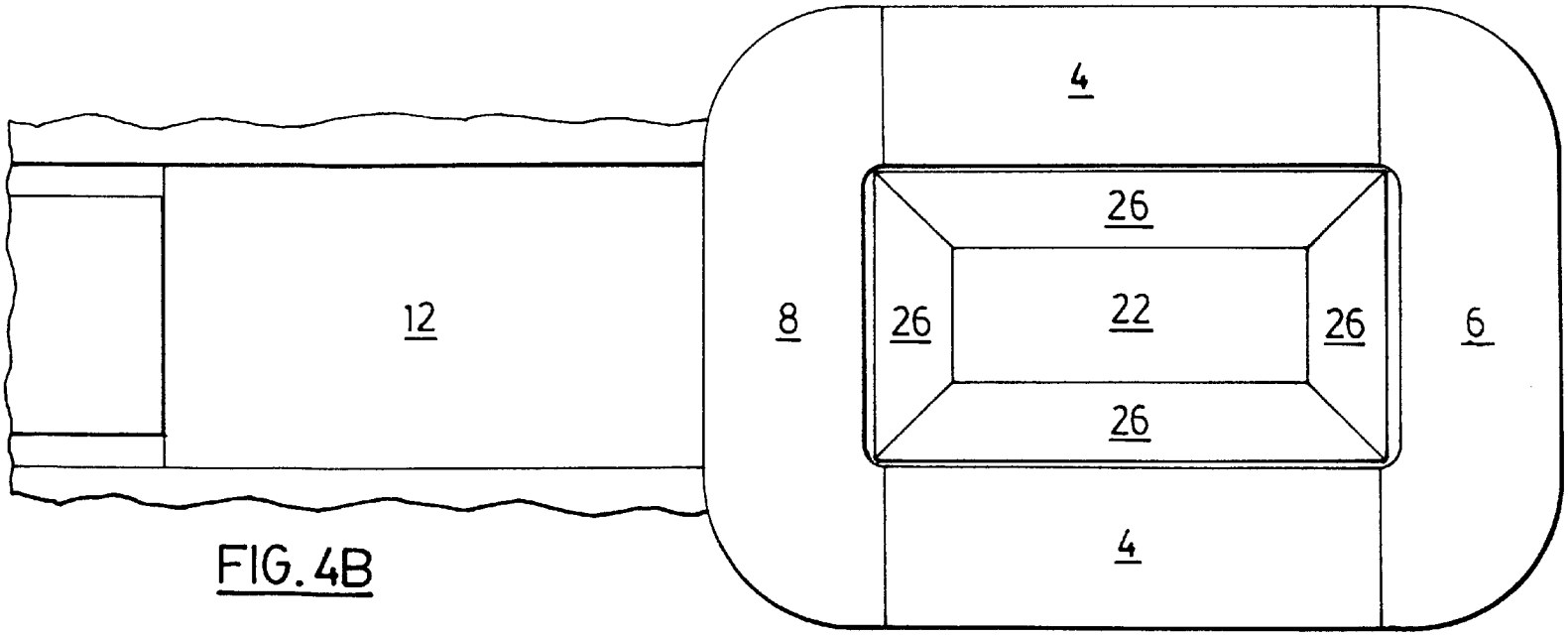
Figure 5A:
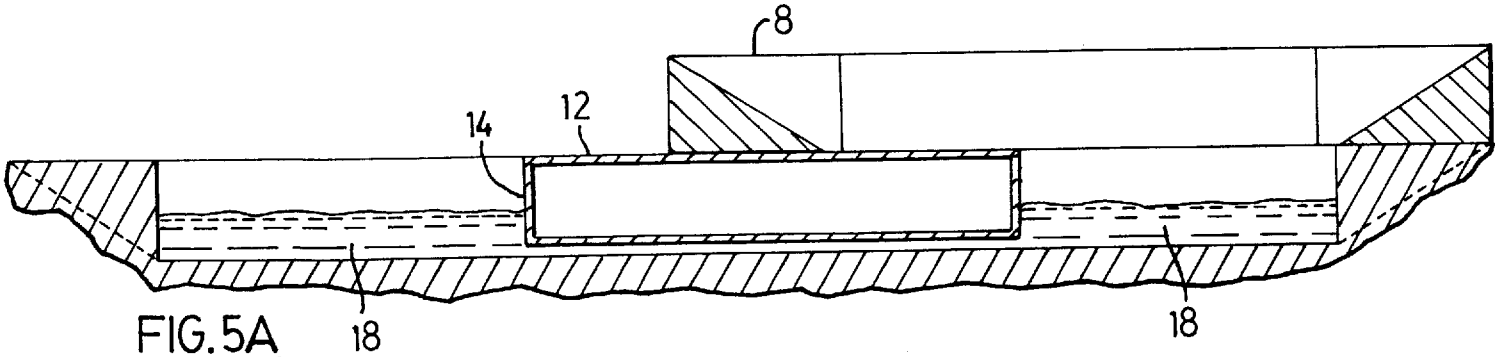
Figure 5B:
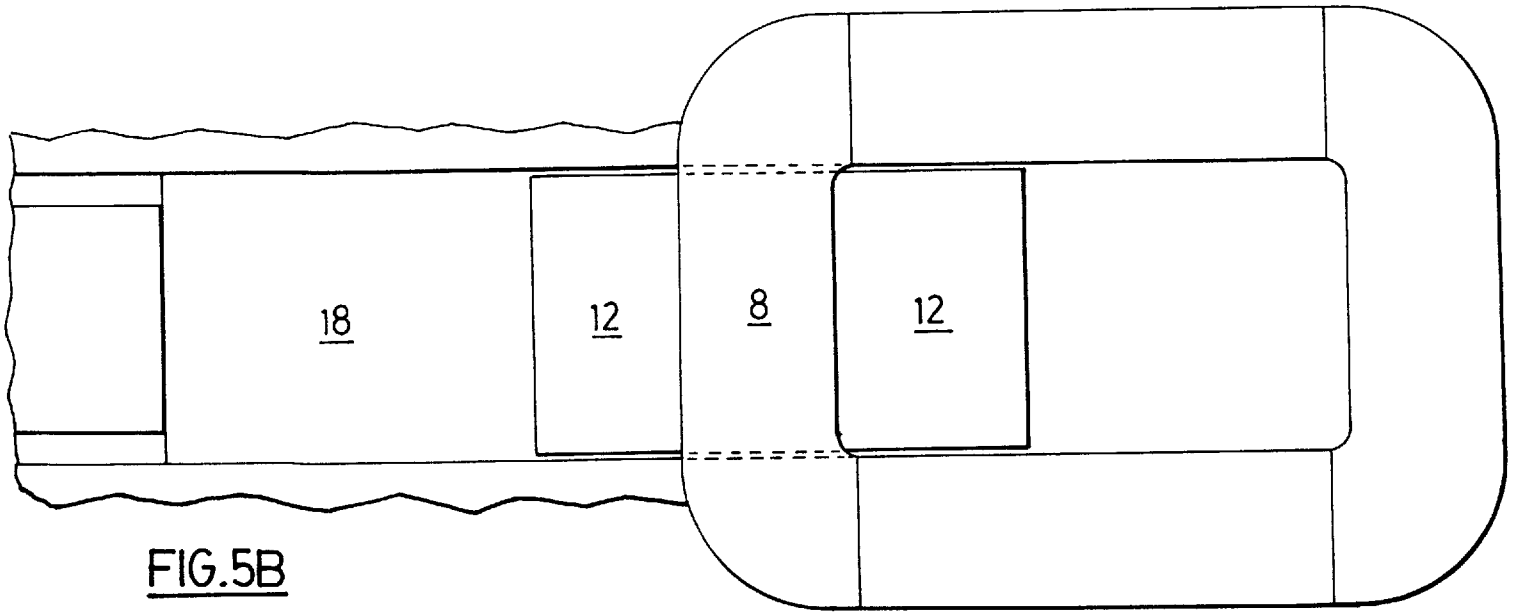
Figure 6A:
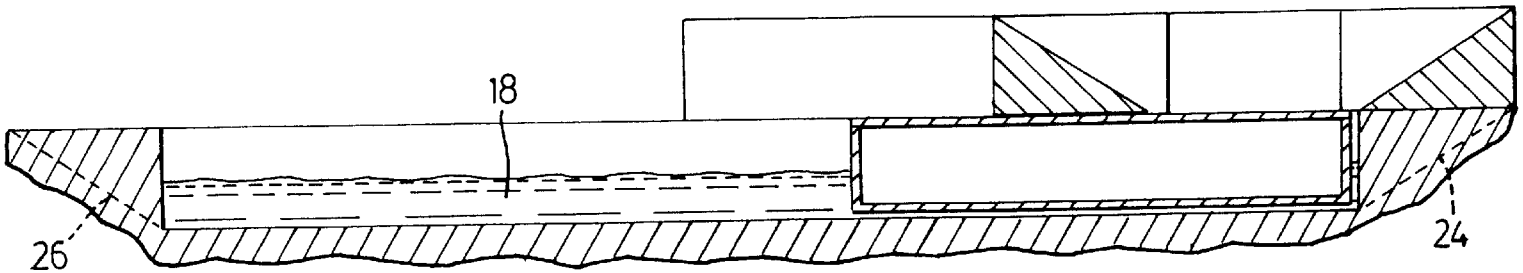
Figure 6B:
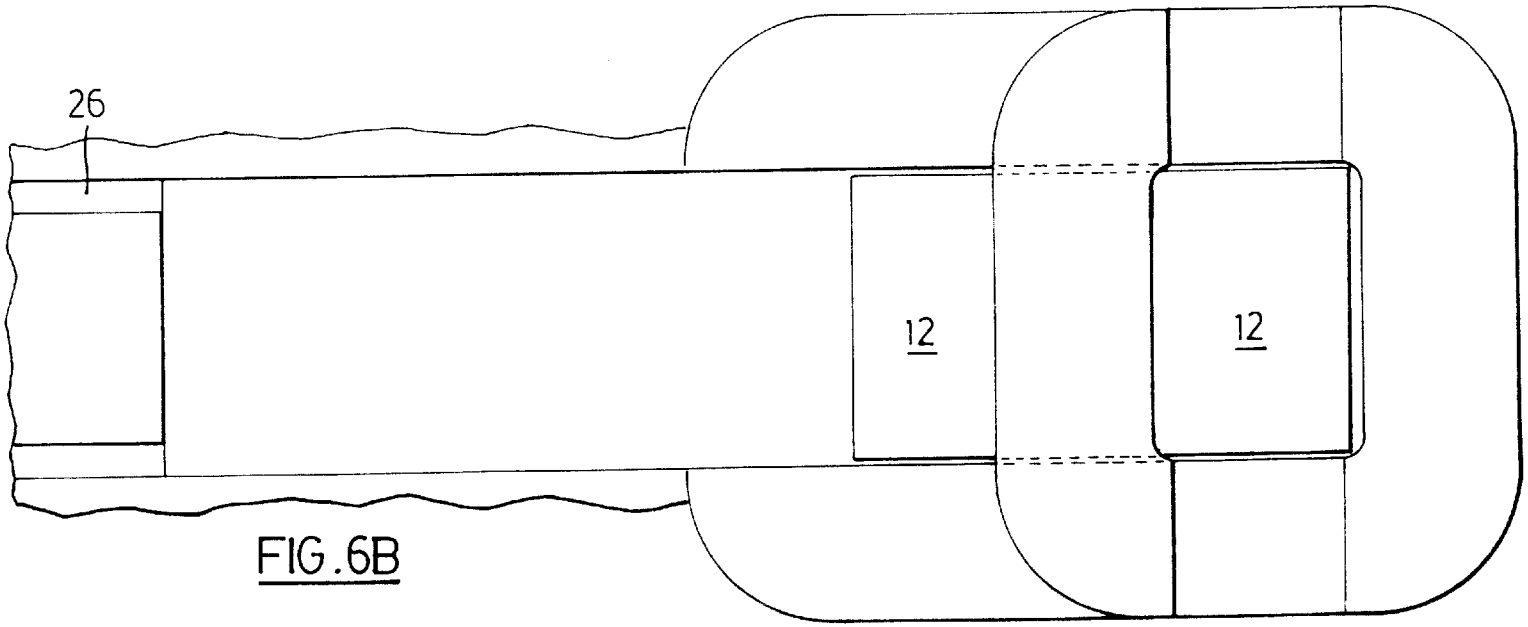

Moving to FIGS. 3A and 3B, the barge has been floated along the length of the dock into the exterior area. On arrival, the water from the dock is pumped back into the barge to arrive at the condition shown in FIGS. 4A and 4B, thus leaving the bottom surface 22 of the dock exposed in the playing area. A ramp 24 may be provided so as to bring vehicles and equipment down onto the base of the dock beneath the seating bank 6; a portion of this seating bank may be made removable, or hinged upwardly, to provide extra clearance for equipment. In view of the lowering of the surface of the playing area to the level of the base of the dock, extra seating units 26 may be disposed around the edges of the playing area within the seating banks 4, 6 and 8, both to reduce the playing area and provide extra seating.

For some events, even this reduced playing area may be too great. To accommodate this, the seating bank 8 is formed as a movable unit. The barge 14 is provided with additional water capacity beyond that necessary to provide sufficient water in the dock to float the barge. Assuming the barge to be in the position shown in FIGS. 4A and 4B, sufficient water is pumped out of the barge just to float the latter in the dock, and the barge is moved to the longitudinal position shown in FIG. 5B, centrally beneath the centre of gravity of seat bank 8, where the remaining water is pumped out of the barge so as to increase the water level in the dock and increase the buoyancy of the barge to the point where it supports the weight of the seating bank 8 in a balanced manner and lifts it from its normal position so that it may be floated on the barge to the position shown in FIGS. 6A and 6B, for example. The underside of the bank 8 is constructed so that the load is distributed over the portion of the playing area beneath the bank 8. At this point, sufficient water may be pumped back into the barge to lower the seating bank 8 onto the seating banks 4. At this point, either the remaining water may be pumped from the dock into the barge if a grass playing surface is desired, or the barge may be floated to the position shown in FIG. 7A, and the remaining water pumped out of the dock to provide the condition shown in FIG. 7A. It will be understood that while the underside of the centre portion of the seating bank 8 is configured to distribute its weight over the surface 12 on the barge 14, the end portions are designed to provide clearance over seating on the banks 4 during movement of the bank 8.

When the exterior area 20 of the dock is empty of water, and not occupied by the barge 14, ramps 26 permit it to be utilized for parking or storage of equipment. It will also be understood that the water 18 may be retained in either the area 2 or the area 20 and used for aquatic sports. Additional facilities may also be provided by installing seating banks around the area 20. Moreover, with the surface 12 in the position shown in FIG. 6B, it would be possible to provide for example two tennis courts, one inside and one outside the main arena. At least in the playing area 2, the bottom of the dock may be provided with refrigerant coils, so that an ice surface may be formed on it.

In order to perform the above described configuration changes, it is necessary to provide means for pumping water into and out of the barge 14, and also means for moving the barge, once floated, longitudinally of the dock. For the latter purpose, winches and cables (not shown) extending between the barge and the ends of the dock may conveniently be utilized.

Figure 8:
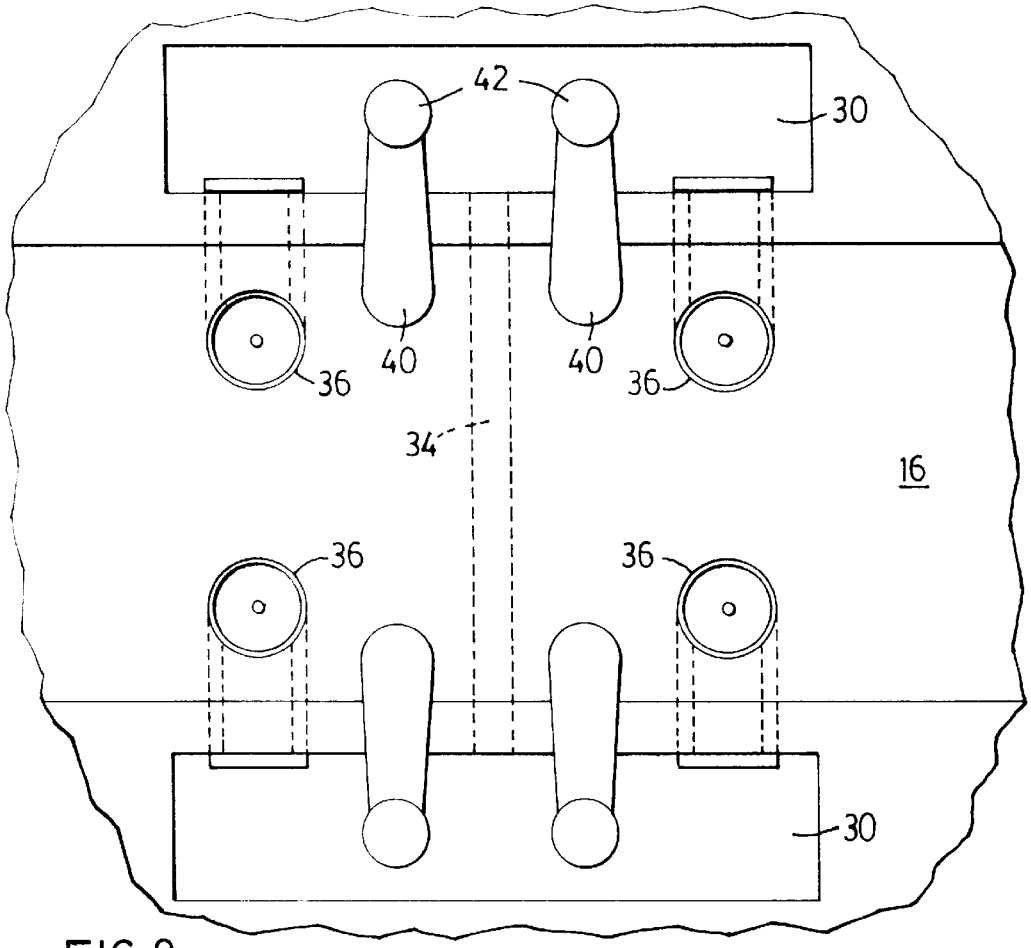
FIG. 8 is a fragmentary plan view of a central portion of the dock shown in FIGS. 1B to 7B.
Figure 9:
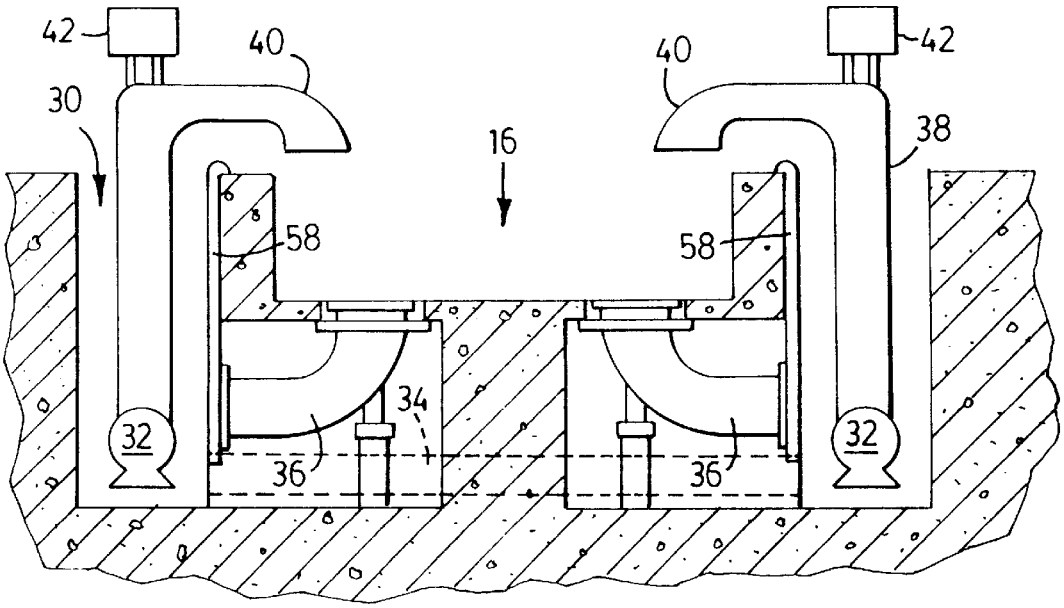
FIG. 9 is a lateral cross-section view on the line 9—9 in FIG. 8.

Referring to FIGS. 8 and 9, pumps 32 may conveniently be located in sumps 30 formed to either side of a central portion of the dock adjacent the normal position of the seating bank 8. The sumps are connected by a passage 34. For the sake of simplicity, the pumps and other related parts are not shown in the previous figures. The sumps are typically some three metres deeper than the typical two metre depth of the dock, and are connected with the bottom of the dock by channels 36, which channels may be closed by valves 58. The sumps enable the pumps to be maintained continuously submerged and primed in water retained in the sump below the level of the dock 16. The pumps are disposed at the base of columns 38 with discharge spouts 40 cantilevered over the path of movement of the barge, with their drive motors 42 arranged vertically above the pumps and above the discharge spouts. The pumps are of a type well known for handling large volumes of water through relatively low lifts in flood control and similar works. Water purification plants (not shown) may also be provided in association with the sumps to purify the water and remove contaminants.

Figure 7A:
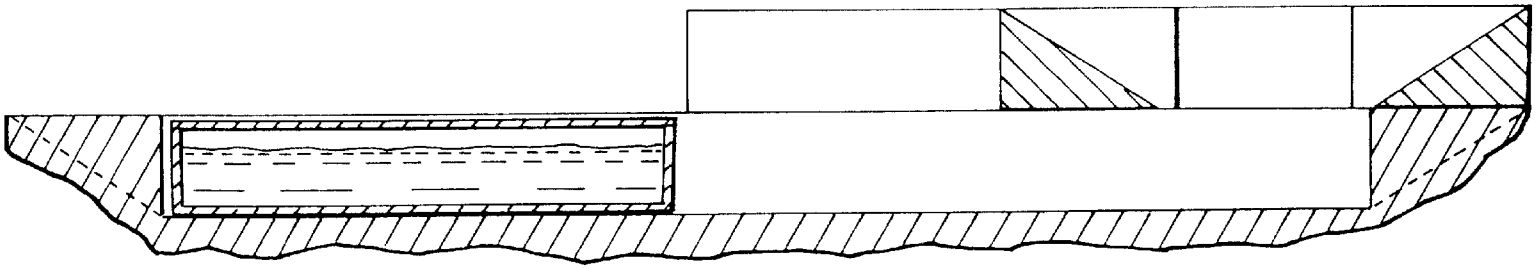
Figure 7B:
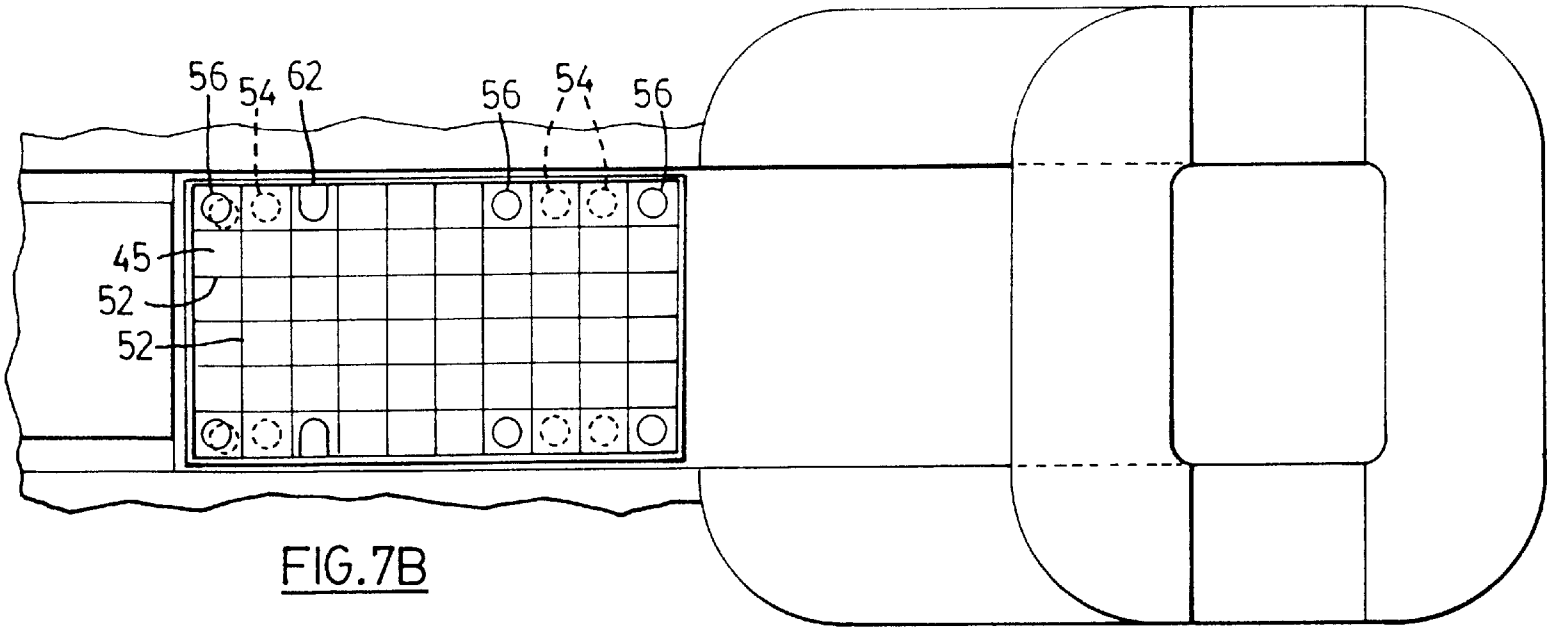
Figure 10:
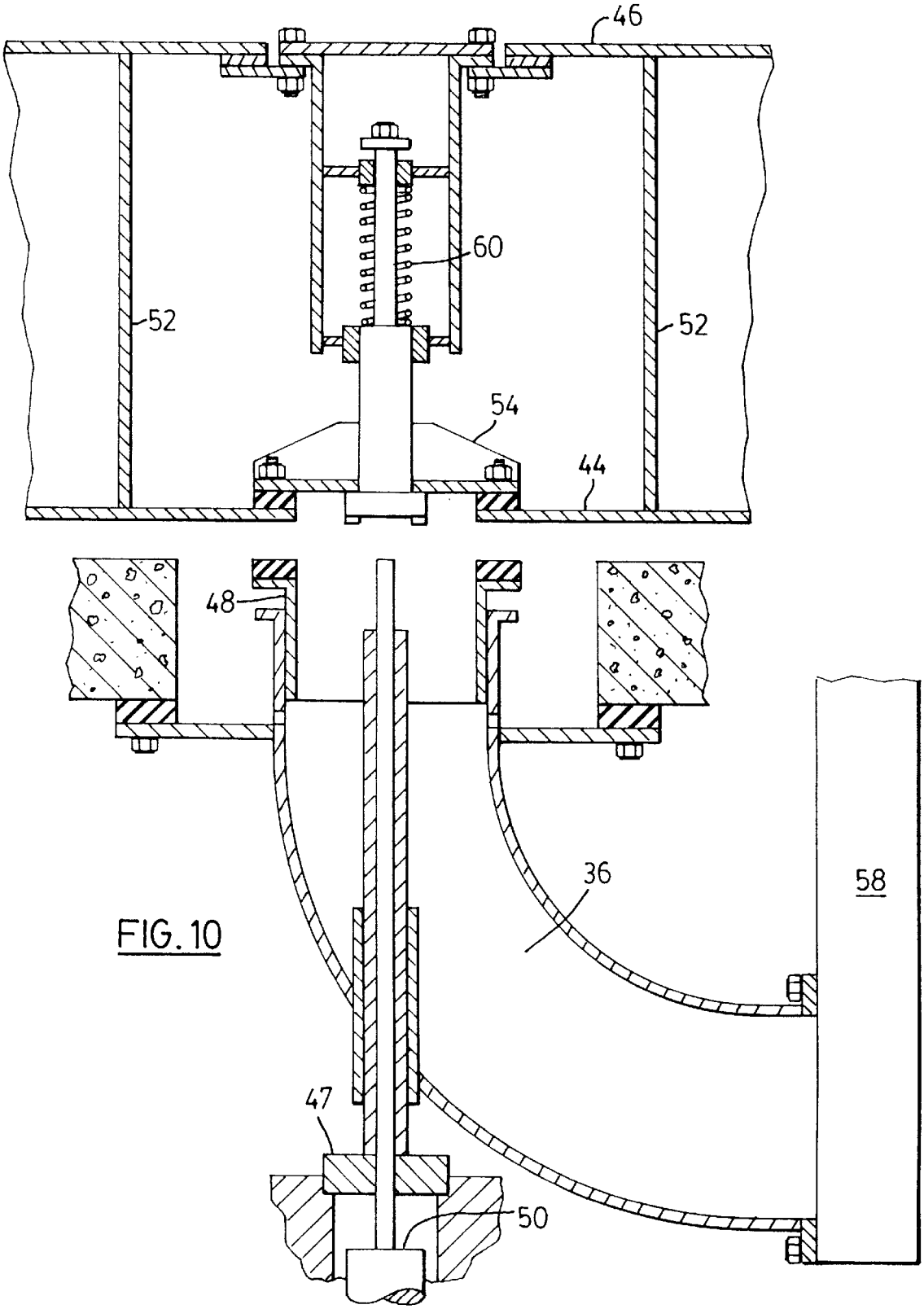
FIG. 10 is a detail showing the cooperation of valve elements in the dock and barge respectively.

Further features of the construction of the barge 14 and the channels 36 are shown in FIG. 7B and 10. Referring to FIG. 7B, the barge has a cellular construction, diaphragms 52 between the cells having openings (not shown) to allow free passage of water within the barge. Along the lateral edges of the barge, certain cells have valves 54 in their bottom walls 44, and certain other cells have openings 56 in their upper walls 46. Except for these edge cells, the cells support grass boxes 45 which contain the soil and grass covering providing the playing surface 12. Surplus water from these boxes drains into the barge. The valves 54 are shown in more detail in FIG. 9, and are located so that the barge, wherever located in any of the positions shown in FIGS. 1A, 1B or 4A, 4B or 5A, 5B will have valves located above two of the passages 36. In these positions, jacks 47 (see FIG. 10) can be actuated to raise sealing collars 48 into contact with the bottom of the barge around the valves 54, and jacks 50 can be actuated to lift the valves 54 off their seats against the pressure of a closing spring 60. Actuating the jacks thus places the interior of the barge in connection with the passages 36 and the sumps 30. In each of the positions of the barge, the openings 56 are arranged so that an opening on each side will be beneath a spout 40.

In operation, and assuming that the barge is in the position and condition shown in FIG. 1, the valves 54 and openings 56 at the left hand end (as shown in the drawings) of the barge will be aligned with the right hand passages 36 and spouts 40 shown in FIG. 8, while the left hand passages 36 and spouts 40 will open into the portion 20 of the dock. In order to commence discharge of the water 18 from the barge, the jacks 46 and 50 associated with the right hand passages 36 are actuated, and the valves 58 associated with all of the passages are opened so that water from the barge will pass through the right hand passages, the sumps 30 and the left hand passages 36 to the portion 20 of the dock. This transfer may be accelerated by opening sluices (not shown) in the left hand end of the barge. As the gravitational transfer slows, the sluices are closed, the valves 58 associated with the left hand passages are also closed, and the motors 42 driving the right hand pumps 32 are started, so that these pumps will draw water from the sumps 30 and discharge it into the dock portion 20 through the associated spouts 40, while water continues to drain from the barge, through the open valves 54.

When sufficient water has been pumped from the barge to float it, the jacks are retracted to close the valves 54 and retract the sealing collars 48, whereafter the barge may be moved to the position shown in FIG. 3.

At this point, if the water is to be drained from the area 2, the valves 58 can be opened in the passages 36, the left hand jacks 46 and 50 can be actuated, and the sluices opened to allow water to pass from the dock into the barge. As the gravitational flow slows, the right hand valves 58 are closed and the motors of the left hand pumps 32 started to discharge water from the dock via the sumps 30 into the openings 56 of the barge aligned with the spouts 40 of the left hand pumps, until the water in the sumps falls below the level of the bottom surface 22 of the dock, at which point the remaining valves are closed and jacks retracted, and the pumps turned off.

Other water displacement operations are handled similarly. When water is to be discharged from the barge when in the position shown in FIG. 5, means 62 may be provided to guide into the dock the water discharged from the spouts 40 from the top of the barge.

By way of example, the barge may have dimensions of 115 metres by 77 metres and be 2 metres deep, and the dock may be 270 metres by just over 77 metres. The barge may have a weight of somewhat over 1500 tonnes, and the associated grass boxes a weight of somewhat over 5000 tonnes, providing a total displacement of about 7000 tonnes required to float the barge. If the seat bank 8 weighs about 1000 tonnes, then the maximum water displacement required in the dock is 8000 tonnes, and this can conveniently be achieved using about 16000 tonnes of water 18. The barge when floating will have a draft of about 1 metre (slightly more when not supporting the seat bank 8, and slightly less when supporting the seat bank since the weight of extra water pumped out of the barge will exceed the weight of the seat bank). The pumps 32 will typically be provided with a capacity of about 1150 tonnes per minute per pump.

I claim:

1. A sports/recreation facility comprising a playing area and banks of seating disposed around said playing area a shallow dock within one end of which the playing area is defined, the dock extending over the playing area and also extending sufficiently outside the playing area in one direction to define an area outside of the playing area and seating banks having dimensions at least equal to the playing area, and a shallow barge floatable within the dock and supporting a playing surface for movement within the dock between said playing area and said outside area, wherein the barge includes a storage volume therein, and the facility further includes pumps for displacing water required to float the barge in the dock between the dock and the storage volume within the barge, and vice-versa.

2. A facility according to claim 1, wherein the playing surface supported by the barge is natural grass.

3. A facility according to claim 2, wherein the barge has a cellular construction, cells other than those adjacent lateral edges of the barge supporting grass boxes containing soil and grass forming the playing surface supported by the barge.

4. A facility according to claim 1, wherein the dock extends beneath a bank of seating at one side of the playing area, said bank of seating being formed as a movable unit, and the barge provides storage for an additional body of water beyond that needed to float the barge in the dock, which water may be expelled from the barge into the dock so as to elevate the barge when beneath said movable bank of seating, whereby to lift said seating bank for movement with said barge between at least two alternative locations relative to the remaining banks of seating and the playing area.

5. A facility according to claim 1, wherein the dock has a bottom surface within the playing area which provides an alternative playing surface or the bottom of a pool for aquatic sports.

6. A facility according to claim 5, wherein additional removable banks of seating are provided for positioning in the dock around a perimeter of the playing area when the barge is located in said outside area.

7. A facility according to claim 1, wherein the pumps are located in sumps formed to either side of a central portion of the dock between said playing area and said external area, and have intakes beneath the dock and outlets above a path of movement of the barge, such that at either end of the path of movement of the barge, at least one but less than all of the intakes being beneath the barge, and at least one but less than all of the outlets being above the barge disengageable coupling means enabling an intake beneath the barge to be connected with the storage volume within the barge, means to close said intakes selectively, and openings in a top surface of the barge to receive discharges from any outlet above the barge, whereby selective operation of said pumps, coupling means and closing means, enables water to be pumped in either direction between said storage volume in the barge and said dock.

* * * * *